US010441498B1

(12) United States Patent
Zhu et al.

(10) Patent No.: US 10,441,498 B1
(45) Date of Patent: Oct. 15, 2019

(54) ACOUSTIC SHOCK WAVE DEVICES AND METHODS FOR TREATING ERECTILE DYSFUNCTION

(71) Applicant: S-WAVE MEDICAL INC., Foster City, CA (US)

(72) Inventors: Da Zhu, Foster City, CA (US); Zhuoyu Chen, Foster City, CA (US)

(73) Assignee: S-WAVE CORP., Foster City, CA (US)

( * ) Notice: Subject to any disclaimer, the term of this patent is extended or adjusted under 35 U.S.C. 154(b) by 0 days.

(21) Appl. No.: 16/164,711

(22) Filed: Oct. 18, 2018

(51) Int. Cl.
*A61H 19/00* (2006.01)
*A61H 23/00* (2006.01)
*A61H 23/02* (2006.01)

(52) U.S. Cl.
CPC ..... *A61H 19/32* (2013.01); *A61H 23/008* (2013.01); *A61H 23/02* (2013.01); *A61H 2201/1654* (2013.01)

(58) Field of Classification Search
CPC ..... A61H 19/32; A61H 23/008; A61H 23/02; A61H 2201/1654
See application file for complete search history.

(56) References Cited

U.S. PATENT DOCUMENTS 2,559,227 A 7/1951 Rieber
4,539,989 A 9/1985 Forssmann et al.
4,713,572 A 12/1987 Bokowski
5,119,801 A 6/1992 Eizenhoefer et al.
5,174,280 A 12/1992 Gruenwald et al.
5,224,468 A 7/1993 Grunewald et al.
5,311,095 A 5/1994 Smith
5,598,051 A 1/1997 Frey
5,941,838 A 8/1999 Eizenhofer
7,507,213 B2 3/2009 Schultheiss et al.
7,527,589 B2 5/2009 Squicciarini
7,601,127 B2 10/2009 Schultheiss et al.
7,841,995 B2 11/2010 Schultheiss et al.
7,988,648 B2 8/2011 Warlick et al.
8,162,859 B2 4/2012 Schultheiss et al.
8,257,282 B2 9/2012 Uebelacker et al.
8,292,835 B1 10/2012 Cimino
9,381,380 B2 7/2016 Ein-Gal
9,913,748 B2 3/2018 Spector
2005/0010140 A1 1/2005 Forssmann
2006/0100550 A1 5/2006 Schultheiss
2007/0239074 A1 10/2007 Ein-gal
2007/0239079 A1 10/2007 Manstein
(Continued)

*Primary Examiner* — Michael T Rozanski
(74) *Attorney, Agent, or Firm* — Morrison & Foerster LLP

(57) ABSTRACT

Devices and methods for generating acoustic shock wave within a cavity is disclosed. The shock wave device optionally includes a housing having a cylindrical portion and a cone frustum portion. The housing optionally forms a cavity configured to receive a penis. The shock wave device optionally includes a plurality of shock wave generators and a coupling assembly having a deformable sac configured to hold shock wave transmitting liquid. The volume of the transmitting liquid is optionally increased or decreased as needed so that the coupling assembly can conform to the shape of the penis. The shock waves generated optionally has an intensity gradient within the cavity of the shock wave device, where the intensity gradient is optionally controllable using a control and power supply unit.

28 Claims, 10 Drawing Sheets

(56) References Cited

U.S. PATENT DOCUMENTS

| | | | | |
|---|---|---|---|---|
| 2008/0065187 | A1 | 3/2008 | Squicciarini | |
| 2008/0125835 | A1 | 5/2008 | Laurent | |
| 2008/0154157 | A1 | 6/2008 | Altshuler | |
| 2009/0069678 | A1 | 3/2009 | Taniyama | |
| 2011/0230793 | A1 | 9/2011 | Larson | |
| 2012/0215142 | A1* | 8/2012 | Spector | A61B 17/2251 601/46 |
| 2012/0253240 | A1 | 10/2012 | Uebelacker et al. | |
| 2015/0231414 | A1 | 8/2015 | Ein-gal | |
| 2016/0038770 | A1 | 2/2016 | Tyler | |
| 2018/0221688 | A1* | 8/2018 | Cioanta | A61N 7/00 |
| 2018/0296383 | A1 | 10/2018 | Blanche | |
| 2019/0151192 | A1 | 5/2019 | Yamashita | |
| 2019/0192377 | A1 | 6/2019 | Kaila | |

* cited by examiner

PRIOR ARTS

ACOUSTIC SHOCK WAVE DEVICES AND METHODS FOR TREATING ERECTILE DYSFUNCTION

FIELD OF THE INVENTION

This disclosure relates generally to a device for generating acoustic shock waves and, more particularly, to a device configured to generating shock waves within an enclosed space for applications in human Erectile Dysfunction treatment.

BACKGROUND

Shock waves are propagating pressure pulses in elastic media, such as air, water and human/animal tissue. Acoustic shock waves have been used for various medical purposes as a noninvasive and non-surgical treatment. It has been proven to be effective to treat a variety of medical conditions in various clinical practices and research reports. For example, in urology, high-intensity focused shock waves are used for breaking kidney/bladder/urethra stones into small fragments on the order of several millimeters in diameter (i.e., lithotripsy), so that the small pieces can be transported out of the patient's body through the urethra. In orthopedics, shock waves are used for pain and inflammation relief/curing in joints and healing of bones. It is also shown that shock wave therapy is effective for healing wound, revascularization, and Peyronie's disease. In particular, it is shown that shock wave therapy is effective for revascularization, increasing blood flow in human tissue, and curing male erectile dysfunction (i.e., the inability or impaired ability to achieve a penile erection).

The erection of a penis requires sufficient arterial inflow into the two corpora cavernosa and corpus spongiosum (with the latter being relatively minor), so that they are engorged and enlarged. The expansion in volume of the corpora cavernosa and corpus spongiosum compresses the cross-section areas of veins within a penile shaft, which suppress the outflow of blood. Shock wave therapy for erectile dysfunction has been clinically shown to be effective by increasing the arterial blood flow and stimulate revascularization within the two corpora cavernosa. Note that the two corpora cavernosa not only exist in the penile shaft, but also exist in the penile crura/roots area. Moreover, the ischiocavernosus muscle, which stabilize the erect penis, and bulbospongiosus muscle, which also contribute to erection, also exist in the penile roots area. The coverage of both regions is necessary for optimized efficacy of the treatment.

Acoustic shock wave generation is often based on three different mechanisms: electrohydraulic, electromagnetic, and piezoelectric. In the electrohydraulic method, a pulse electric discharge between two closely positioned electrodes inside water induces a sudden vaporization of small amount of water nearby. This rapid increase of volume caused by the vaporization creates a pressure pulse in the water, thus generates radial propagating shock waves. In the electromagnetic method, an electric current pulse in a conductor coil results in a pulsed electromagnetic field, which in turn repels a conductive film having certain elastic properties and positioned closely to the coil, thereby generating a momentary (e.g., pulsed) displacement in the conductive film. The momentary displacements in turn generate shock waves with wave fronts parallel to the metal film surface. Alternatively, in the piezoelectric shock wave generation method, electrical voltage pulses are applied to an array of piezoelectric ceramic tiles. The voltage pulses induce volume expansions and contractions of the ceramics with each, thereby generating shock waves with wave fronts parallel to the ceramic surfaces.

In some devices and methods, shock waves originate from only a small area of the device and target one or more focal points or a focal volume (e.g., by utilizing an ellipsoidal or parabolic reflection surface to redirect the shock wave (e.g., generating directly from a partial spherical surface generator (electromagnetic or piezoelectric), or reflecting using a surface. Some of the discussed designs share a key feature that the shock wave transducers have a window through which shock waves are emitted, and this window is configured to transmit shock waves towards a specific direction regardless whether the shock waves are convergent or divergent. The shock wave energy exits the window and propagates away from the window towards the target. Using these shock wave devices requires an operator to hold the patient's penis with one hand, and to scan the shock wave generating head with the other hand along the length of the penis on both sides for the coverage of both corpora cavernosa. Furthermore, some of the discussed devices and methods do not contain the generated shock waves to a specific volume or cavity when treating a patient's penis. For example, FIG. 1A shows a focusing device with a point source (usually realized using electrohydraulic method) located in one focal point of an ellipsoid. The radial generated shock waves are reflected by the ellipsoidal surface and become focused on the other focal point of the ellipsoid outside an exit window of the generator. FIG. 1B shows a device for generating planar shock wave by reflecting the shock waves generated by a point source using a parabolic curved surface. By modifying the shape of the reflection surface or the shape of the surface generator, the shock wave emission can be changed from convergent to divergent. All the prior arts have a share feature, which is an exit window and a certain direction of transmission regardless of convergent, divergent, or planar.

SUMMARY OF THE INVENTION

The previously-discussed devices and methods are ill-suited for treating erectile dysfunction for several reasons. Despite the use of ellipsoidal/parabolic shock wave reflectors, designs where shock wave generation occurs at only a small area of a device cannot (nor are they intended to) deliver substantially uniform shock wave intensities to a volume of cavity that houses a patient's penis. As a result, a patient's penis will be subject to varying degrees of shock wave intensity depending on the focal patterns (e.g., focal areas or volumes) of the device, which may not account for the individual variations of a patient's penis and thus fail to direct efficacious shock wave dosage to the areas important to the erection process (e.g., especially the crura and inside-the-torso) portions of corpora cavernosa. Designs employing planar shock wave sources requires a skilled operator to move the source about the patient's penis so shock waves can reach different areas of the penis from different directions. As a result, the efficacy of therapy is highly dependent on different operators, resulting in inconsistency. Furthermore, the crura and the shaft cannot be done simultaneously. Finally, designs that do not contain the generated shock waves to a specific volume or cavity fail to ensure that substantially all the generated shock wave energy are expended in the treated tissues, thereby decreasing treatment efficiency and increasing inconsistency. In summary, the discussed methods and devices are inconsistent, inefficient, and time-consuming. All of the drawbacks prevent the popularization of shock wave therapy for treating erectile dysfunction.

Therefore, there is a need for a shock wave device and method that can generate a shock wave field that treat both the penile shaft and crura simultaneously and uniformly, with optional control of the intensity gradients of generated shock wave fields, so that the treatment is effective and time efficient. Such a device should preferably generate shock waves at multiple points within a cavity that substantially encloses a treated penis, so that shock waves can be distributed substantially uniformly to all parts of the treated penis. Such a device would reduce the time for treatment and improve consistency of efficacy, and sufficiently easy to use such that a patient could consistency and efficaciously administer the treatment himself without the requisite advanced skills demanded by other types of shock wave erectile dysfunction treatments.

Some aspects of the present disclosure provide a device for generating an acoustic shock wave field within a cavity. In some aspects of the disclosure, the shock wave device optionally includes a housing having a cylindrical portion and a cone frustum portion. In some embodiments, the housing optionally forms a cavity configured to receive a penis. The shock wave device optionally includes a plurality of shock wave generators. In some embodiments, the plurality of shock wave generators optionally include a combination of a conductive thin film and a plurality of conductive wire segments sandwiched by the conductive thin film and the housing, where the conductive thin film and the conductive wire segments are insulated from each other. In some embodiments, the plurality of shock wave generators optionally include a plurality of piezoelectric ceramics disposed on an inner surface of the housing. In some embodiments, the shock wave device optionally includes a coupling assembly disposed over the plurality of shock wave generators. In some embodiments, the coupling assembly optionally has a deformable sac configured to hold shock wave transmitting liquid. The volume of the transmitting liquid is optionally increased or decreased as needed so that the coupling assembly can conform to the shape of the penis.

In some aspects of the disclosure, the shock waves generated optionally has an intensity gradient (e.g., non-uniform intensity) within the cavity of the shock wave device by using different shock wave generators, changing the placement of the shock wave generators, or varying an electrical signal that is sent to the shock wave generators. In some embodiments, the intensity gradient is optionally controllable using a control and power supply unit.

The various aspects of the present disclosure provide devices and method that can confine the generated shock wave pulses within the cavity and distribute the generated shock waves substantially within the cavity. As a result, the entire desired volume of treatment is immersed in the shock wave field, and the entire volume can be treated simultaneously. This would significantly improve shock wave treatment efficiency and consistency of efficacy, since it obviates the extensive (and often manual) scanning using directed shock wave sources in prior arts. Furthermore, the controllable and adjustable intensity gradient of the shock waves generated using various aspects of the present disclosure offers more customizable treatment options for various indications and severities, thereby making the shock wave therapy more effective.

DETAILED DESCRIPTION OF EMBODIMENTS

In the following description of examples, reference is made to the accompanying drawings which form a part hereof, and in which it is shown by way of illustration specific examples that can be practiced. It is to be understood that other examples can be used and structural changes can be made without departing from the scope of the disclosed examples.

Figure 1A:
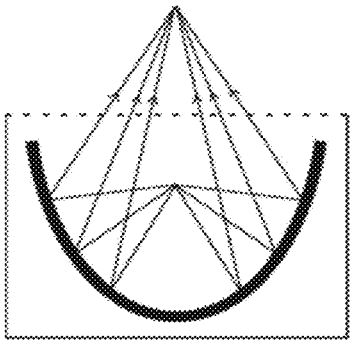
FIGS. 1A-B illustrate various prior art shock wave generation devices and methods.
Figure 1B:
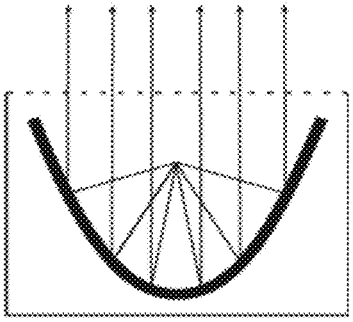
Figure 2A:
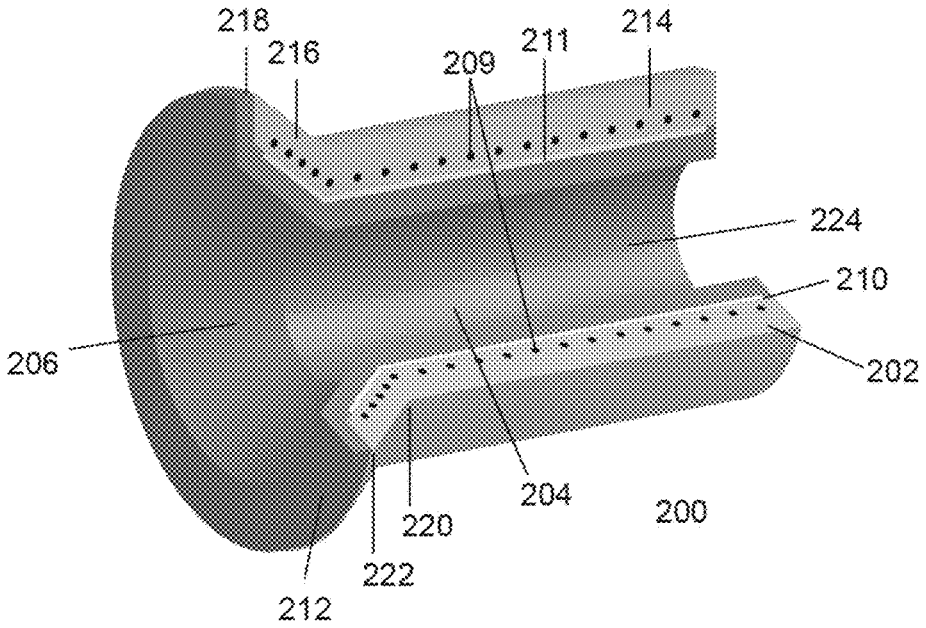
FIGS. 2A-2B illustrate an exemplary shock wave device 200 according to various aspects in the present disclosure.
Figure 2B:
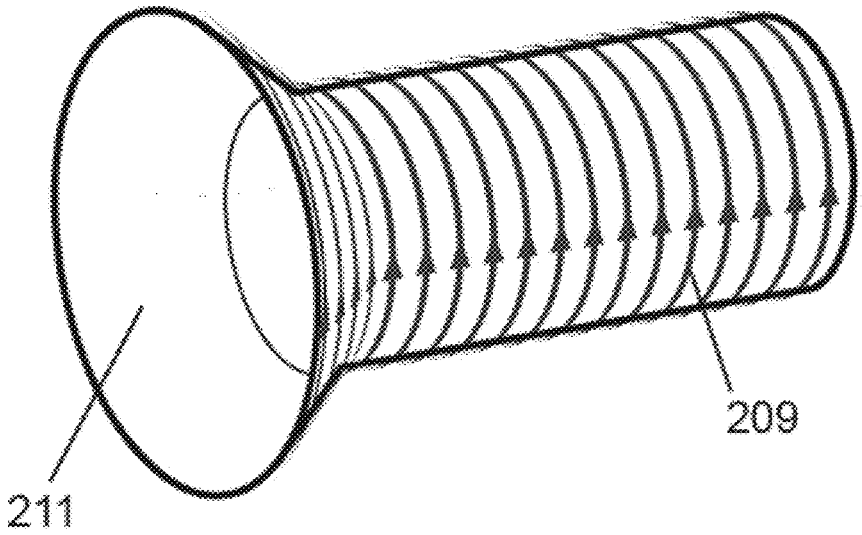

FIGS. 2A-2B illustrate an exemplary shock wave device 200 according to various aspects of the present disclosure. The device 200 includes a housing 202 that has a substantially cylindrical portion 214 and a cone frustum portion 216, as well as an inner surface 210 that expands to both the cylindrical portion 214 and the cone frustum portion 216. The cone frustum portion 216 of the housing has a smaller circumference 220 and a larger circumference 222. Device 200 further includes a cavity 204 bound by the housing 202 and a first opening 206 in the housing that gives access to the cavity 204. In some embodiments, device 200 further includes a second opening 224 on the opposite side of the first opening 206. In some embodiments, the housing is optionally manufactured using various suitable materials generally known in the art, such as metal or plastic; the housing is optionally manufactured using production processes generally known in the art, such as injection molding, Computer Numerical Control (CNC) subtractive machining, or computerized additive manufacturing (i.e., 3-D Printing). Shock wave device 200 optionally includes multiple electromagnetic shock wave generators: specifically, multiple turns of a conductive wire coil 209 sandwiched between a conductor film 211 and the housing 202. The multiple electromagnetic shock wave generators (209 and 211) are located on at least a substantial portion of the inner surface 210 of the housing 202, so that shock waves originate from a substantial area of the three-dimensional surface defined by the housing 202. In some preferred embodiments, as illustrated in FIGS. 2A-2B, the multiple electromagnetic shock wave generators are located throughout substantially all of the inner surface 210 of the housing 202. Each shock wave generator (e.g., the combination of each turn of a conductive wire coil 209 and the conductor film 211) is configured to generate a shock wave propagating within the cavity 204: when a pulsed electric current is applied in the coil (e.g., 209, shown in FIG. 2B together with conductive thin film 211 without showing the housing), an electromagnetic field with pulsed energy is generated. Notably, the pulsed electromagnetic field is significantly different from a static magnetic field that could be generated by this coil with a constant flowing electric current. Based on Maxwell's equations, a rapidly changing magnetic field in time would generate electric field, and the generated electric field would also generate magnetic field since it is changing rapidly, too. Therefore, the electromagnetic field generated by the pulsed current in the coil is a complex electromagnetic field which expels the metal thin film to make a sudden elastic displacement. Such displacement results in a pressure pulse and generates an inward propagating shock wave. Device 200 also includes a coupling assembly 212, which includes an inflatable sac (218).

Figure 2C:
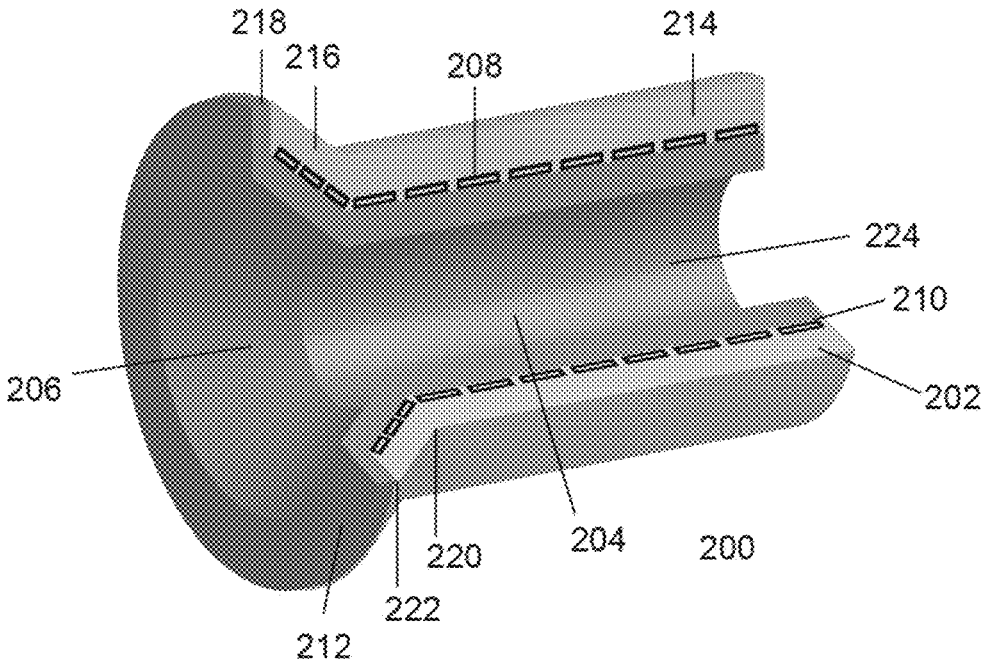
FIGS. 2C-2D illustrate another exemplary shock wave device 200 according to various aspects in the present disclosure.
Figure 2D:
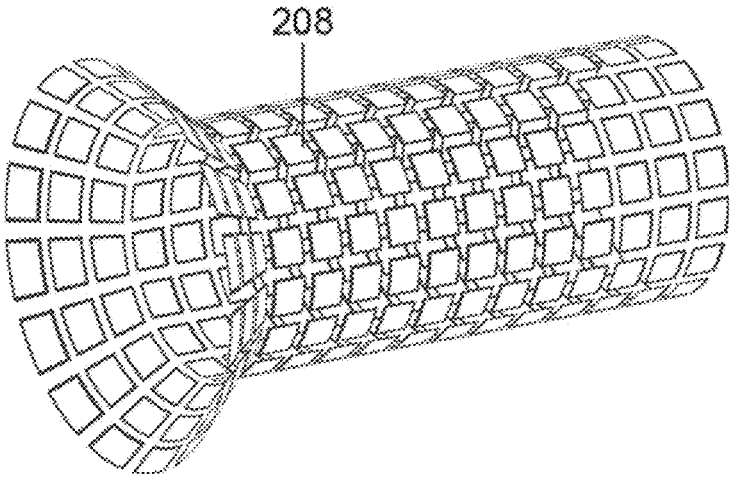

FIGS. 2C-2D illustrate another exemplary shock wave device 200 according to various aspects of the present disclosure. The device 200 includes a housing 202 that has a substantially cylindrical portion 214 and a cone frustum portion 216, as well as an inner surface 210 that expands to both the cylindrical portion 214 and the cone frustum portion 216. In some embodiments, device 200 further includes a second opening 224 on the opposite side of the first opening 206. The cone frustum portion 216 of the housing has a smaller circumference 220 and a larger circumference 222. In some embodiments, the housing is optionally manufactured using various suitable materials generally known in the art, such as metal or plastic; the housing is optionally manufactured using production processes generally known in the art, such as injection molding, Computer Numerical Control (CNC) subtractive machining, or computerized additive manufacturing (i.e., 3-D Printing). Device 200 further includes a cavity 204 bound by the housing 202 and a first opening 206 in the housing that gives access to the cavity 204. Shock wave device 200 further includes multiple piezoelectric ceramic tile shock wave generators 208 disposed on the inner surface 210 of the housing 202. Piezoelectric ceramics square tiles 208 (shown as example) are disposed on the inner surface 210 of the housing 202. The multiple piezoelectric shock wave generators 208 are located on at least a substantial portion of the inner surface 210 of the housing 202, so that shock waves originate from a substantial area of the three-dimensional surface defined by the housing 202. In some preferred embodiments, as illustrated in FIGS. 2C-2D, the multiple electromagnetic shock wave generators 208 are located throughout substantially all of the inner surface 210 of the housing 202. A pulsed signal can be applied to any of the piezoelectric tiles and cause sudden expansion and contraction of the tile, thereby generating a pressure pulse. Device 200 also includes a coupling assembly 212, which includes an inflatable sac (218).

Figure 3B:
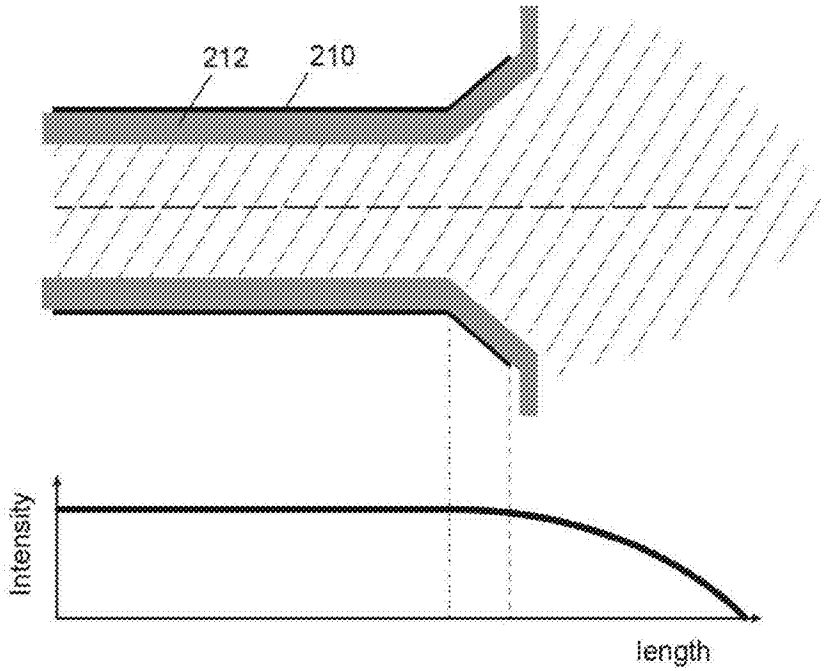
FIGS. 3A-3B illustrate exemplary shock wave intensity gradients generated by exemplary shock wave devices according to various aspects of the present disclosure.
Figure 3A:
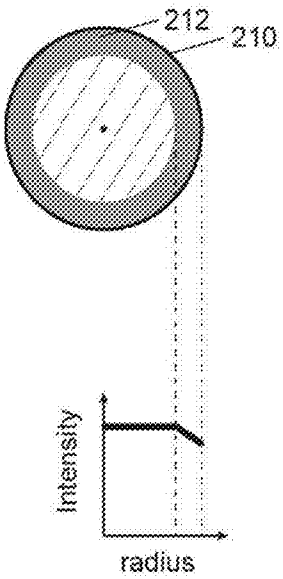

FIGS. 3A-3B illustrate exemplary shock wave intensity gradients generated by exemplary shock wave devices according to various aspects of the present disclosure. FIG. 3A illustrates an exemplary shock wave intensity as a function of the distance from the radial axis of the shock wave generator device. The intensity here is defined as shock wave energy density. The exemplary shock wave intensity as show in FIG. 3A is substantially uniform as a function of distance from the radial axis within the cavity filled by human or animal tissue (not shown) for treatment, while the intensity is lower in the coupling assembly 212 (e.g., all or substantially all of the shock wave energy generated by the shock wave device is consumed within the treated human or animal tissue). This can be realized due the following reasons. Due to geometry effect and conservation of energy, shock wave energy density should be higher approaching the center of the volume. Yet this intensification is optionally compensated by the decay of energy from the energy consumption for the treatment of the tissue. This compensation optionally homogenizes energy density within the treated volume. In some embodiments, as illustrated in FIG. 3B, the housing (e.g., 210) of an exemplary shock wave device includes a cylindrical portion and a cone frustum portion, and all or substantially all of the shock wave energy generated by shock wave generators (not shown) disposed in the cylindrical portion of the shock wave device is uniformly or substantially uniformly (e.g., the intensity along the length is uniform or substantially uniform) contained in the cylindrical portion of the device. Furthermore, as illustrated in FIG. 3B, the intensity of shock waves generated by shock wave generators in the cone frustum portion of the housing optionally decreases due to the angular shape of the cone frustum portion of the housing (e.g., an non-uniform intensity gradient exists in the generated shock wave field). The angular shape of the cone frustum portion also causes shock waves generated by shock wave generators disposed on the cone frustum portion to reach further than the length of the housing on the cone frustum end (e.g., FIG. 3B), thereby advantageously enabling generated shock waves to treat an area of the penis that connects to the torso (i.e., the corpus spongiosum of a penis, which extends length-wise from the visible portion of the penis shaft into the torso; shock waves having an intensity gradient as illustrated in FIG. 3B can reach both the portion of the corpus spongiosum in the visible penis shaft and the portion in the body, thereby increasing the treatment efficacy and reducing treatment time).

Figure 4:
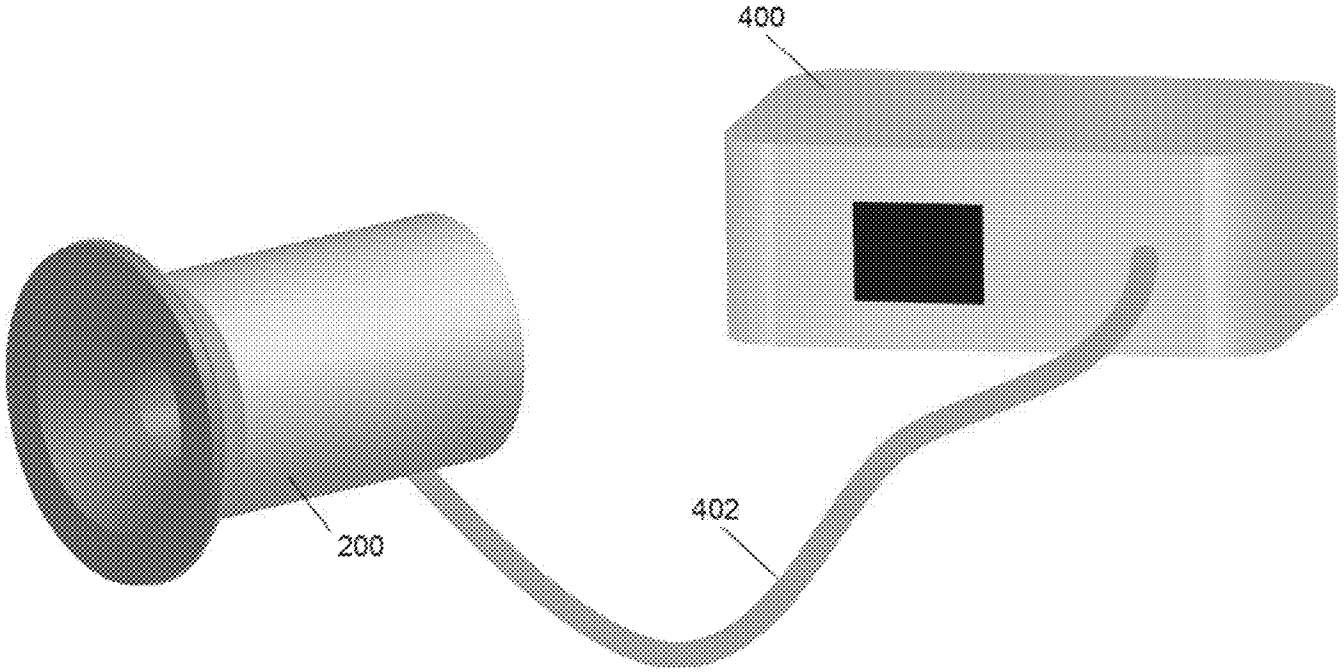
FIG. 4 illustrates an exemplary shock wave device with a control and power supply unit according to various aspects of the present disclosure.

FIG. 4 illustrates an exemplary shock wave device with a control and power supply unit according to various aspects of the present disclosure. The control and power supply unit 400 is configured to connect electrically to the shock wave generators (e.g., 208 or 209 and 211) via a connection line 402 in order to provide a pulsed electrical signal (e.g., an pulsed voltage or a pulsed current) to the shock wave generators. In some embodiments, the control and power supply unit 400 optionally controls the shock wave generators by sending multiple control signals, where each control signal controls a subset of the shock wave generators (e.g., a first control signal controls shock wave generators disposed on the cylindrical portion of the housing (e.g. 214) and a second control signal controls shock wave generators disposed on the cone frustum portion of the housing (e.g., 216). In some embodiments, the control and power supply unit optionally includes one or more user-selectable settings that adjust the intensity of shock wave pressure pulses produced by a group of the shock wave generators by, for example, adjusting the pulse amplitude, pulse width, pulse repetition rate, or pulse delay (e.g., phase) of the pulse voltage signal or the pulse current signal.

The control and power supply unit 400 optionally controls the inflation and deflation of the deformable sac 218 in the coupling assembly 212 by filling the deformable sac with shock wave transmission fluid or draining shock wave transmission fluid from the deformable sac via the connection line 402. In some embodiments, the control and power supply unit 400 optionally includes one or more voltage or current-pulse generating circuitry (e.g., switch capacitors, voltage transformers, diode rectifiers, clock signal generators, isolators, and other electronic circuitry and components generally known in the arts) configured to generate a pulsed voltage signal, a pulsed current signal, or both. In some embodiments, the control and power supply unit 400 optionally includes one or more user-selectable settings that adjust e.g., the magnitude, duration, repetition period, and other parameters of the pulsed signal (e.g., voltage or current). In some embodiments, the control and power supply unit optionally includes one or more user-selectable settings that adjust the amount of shock wave transmission fluids in the sac. In some embodiments, one or more pressure sensors (e.g., Piezoresistive, Capacitive, Piezoelectric, Micro Electro-Mechanical System (MEMS), or other types of pressure sensors generally known in the art) are optionally disposed on or within the coupling assembly (e.g., 212) and configured to sense the pressure of the sac pressing against the body appendage by sensing the pressure of the shockwave transmission liquid as the sac is being filled with the shockwave transmission liquid. In some embodiments, the control and power supply unit optionally receives an electrical signal transmitted from the one or more pressure sensors corresponding to a measured pressure value from the coupling unit and, in accordance with the measure pressure, stops filling the sac with shock wave transmission liquid.

Figure 6A:
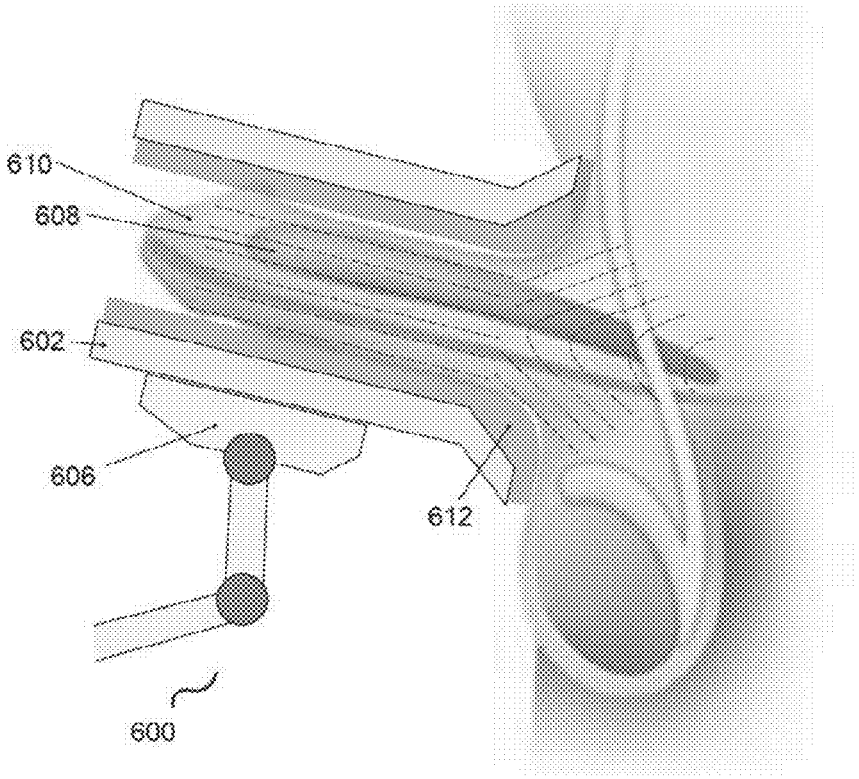
FIGS. 6A-6B illustrate an exemplary method of using an exemplary shock wave device according to various aspects of the present disclosure.
Figure 6B:
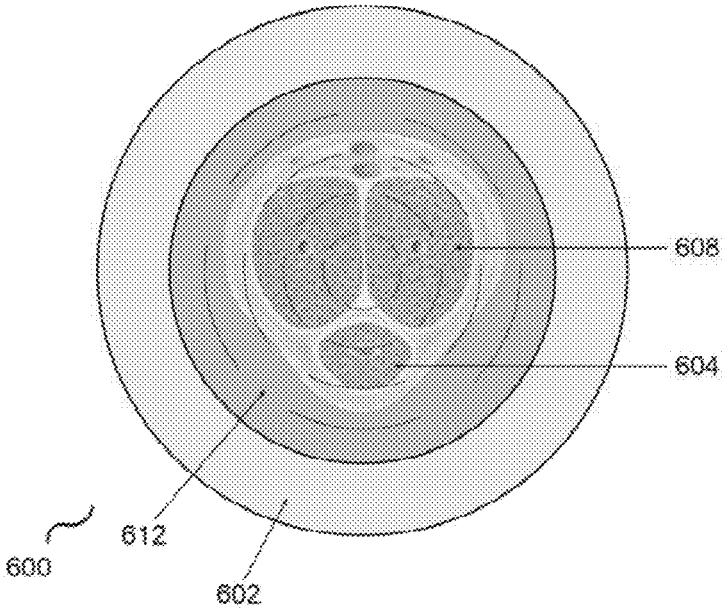

FIGS. 6A-6B illustrate an exemplary method of using an exemplary shock wave device according to various aspects of the present disclosure. Shock wave device 600 is an exemplary shock wave device and includes a housing 602, a mechanical arm 606 configured to support and position the shock wave device 600, and a coupling assembly 612. Preferably, housing 602 of shock wave device 600 optionally includes a cylindrical portion and a cone frustum portion, and a plurality of (e.g., electromagnetic or piezoelectric) shock wave generators are dispose on the inner surface of the cone frustum portion, and the coupling assembly covers the cone frustum portion of the housing. Shock wave device 600 optionally includes one or more elements (e.g., control and power supply unit, deformable/inflatable sac etc.) described in various embodiments of the present disclosure.

To administer erectile dysfunction treatment to a patient's penis, the penis is received into the cavity of the housing through a first opening (e.g., the proximal opening shown in FIG. 6A). Preferably, substantially all of the exposed portions of the penis shaft is received within the cavity of the housing 602 such that the proximal opening of the housing 202 touches the patient's scrotum (e.g., the penis is enclosed by the housing 602), as shown in FIG. 6A.

The coupling assembly couples with the penis (e.g., the coupling assembly optionally includes a deformable sac according to various embodiments in the present disclosure, and the sac is filled with a volume of shock wave transmission liquid), and the shock wave device generates (e.g., using a plurality of shock wave generators (not shown) described in various embodiments of the present invention) a shock wave field including generated shock waves. The coupling assembly 612 then transmits the shock waves to the penis shaft (e.g., the corpus cavernousum 608, the corpus spongiosum 604, etc.) the transmitted shock waves optionally reaches the penis glans 610. Preferably, the portion of coupling assembly 612 that covers the cone frustum portion of the housing 602 transmits shock waves generated by shock wave generators disposed on the cone frustum portion of the housing 602 to the crura or root (e.g., inside-the-torso) portions of the corpus cavernousum 608 and the corpus spongiosum 604, thereby ensuring that shock waves reach all portion of a penis that affects achieving erection.

Figure 7:
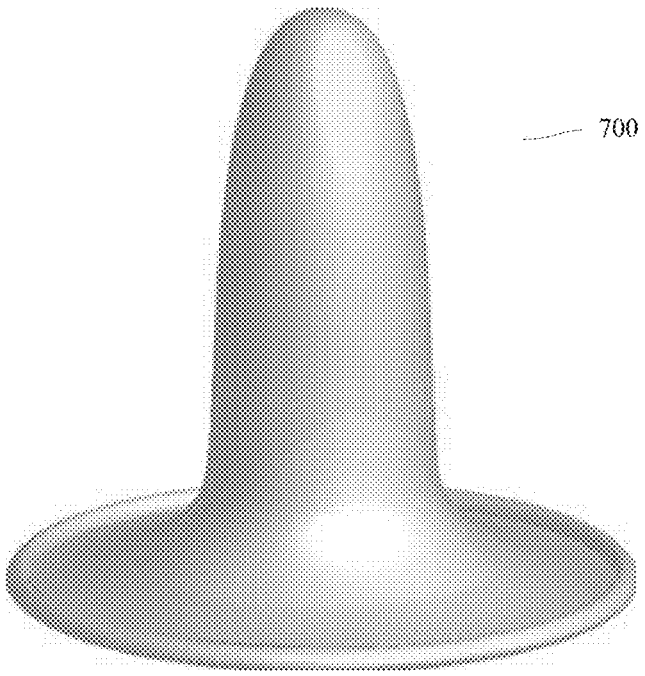
FIG. 7 illustrates a shock wave device including an optional sheath membrane according to various aspects of the present disclosure.

FIG. 7 illustrates a shock wave device including an optional detached membrane according to various aspects of the present disclosure. The detached membrane 700 is configured to sheathe a patient's penis before the shock wave device (e.g., 600) receives the patient's penis into the cavity. In some embodiments, the sheath membrane 700 is optionally made from, e.g., latex, polyurethane, polyisoprene, or other material generally known in the art. The sheath membrane optionally acts as a sanitary barrier between the patient's penis and the shock wave device, thereby prevention disease transmission and increasing safety of the various exemplary treatment methods disclosed herein.

Various aspects of the present disclosure include an extracorporeal shock wave apparatus (e.g., 200). In some embodiments, the apparatus includes a housing (e.g., 202) configured to enclose a penis. In some embodiments, the apparatus (e.g., 200) optionally includes a cavity (e.g., 204) bound by the housing, the housing further comprising a first opening (e.g., 206) configured to receive the penis into the cavity. In some embodiments, the cavity or the housing optionally have dimensions and shapes that are slightly larger than the typical size of the penis to be inserted; thus, in some embodiments where the apparatus is intended to enclose a penis, the cavity optionally has a size (e.g., width, length, diameter, etc.) slightly larger than the typical size of a penis.

In some embodiments, the apparatus optionally includes a plurality of shock wave generators (e.g., 208) disposed on a first surface (e.g., inner surface 210) of the housing (e.g., the side facing the cavity), each shock wave generator configured to generate a shock wave propagating within the cavity. In some embodiments, the plurality of shock wave generators are placed uniformly; that is, each of the plurality of shockwave generators is optionally separated by the same distance from another shock wave generator.

In some embodiments, the apparatus optionally includes a coupling assembly (e.g., 212) that is disposed over the plurality of shock wave generators (e.g., 208) such that the plurality of shock wave generators are sandwiched by the first surface of the housing (e.g., inner surface 210) and the coupling assembly. In some embodiments, the coupling assembly is optionally created using methods generally known in the art such as adhesives, retainers, etc. In some embodiments the coupling assembly is optionally detachable, that is, the coupling assembly can be repeatedly removed from and re-attached inside the cavity, covering the plurality of shock wave generators disposed on the inside surface of the housing. In some embodiments, the coupling assembly is optionally configured to transmit the plurality of shock waves to the penis. In some embodiments, the coupling assembly optionally includes a medium that transmits shockwave pressure pulses with less intensity decay than air. Notably, a shock wave device according to various embodiments of the present invention can confine the generated shock wave pulses within the cavity and distribute the generated shock waves substantially within the cavity. As a result, the entire desired volume of treatment is immersed in the generated shock waves, and the entire volume can be treated simultaneously. This would significantly improve shock wave treatment efficiency and consistency of efficacy, and reducing treatment time, since it obviates the extensive (and often manual) scanning using directed shock wave sources in prior arts.

In some embodiments, the housing (e.g., 202) optionally has a substantially cylindrical shape. That is, in some embodiments, the housing optionally has a circular or substantially circular cross-section. In some embodiments, the housing optionally has an elongated length (e.g., the shape of a shaft). In some embodiments, the housing (e.g., 202) optionally has a first portion (e.g., 214) having a substantially cylindrical shape and a second portion (e.g., 216) having a shape of a cone frustum, where the cone frustum has a first base with a first circumference (e.g., 220) and a second base with a second circumference greater than the first circumference (e.g., 222), and where the first portion (e.g., 214) and the second portion (e.g., 216) are connected at the first base (e.g., 220). Notably, a shock wave device whose housing includes both a cylindrical-shaped portion and a frustum-shaped portion can enclose and deliver shock waves to both the portion of the body appendage protruding from the torso and any portion of the body appendage within the torso, thereby increasing treatment efficiency and efficacy and reducing treatment time.

In some embodiments, the plurality of shock wave generators optionally includes a plurality of piezoelectric ceramic tiles (e.g., 208) disposed on the inner surface of the housing. In some embodiments, the piezo electric ceramic tiles are optionally round, oval, hexagonal, rectangular, square, or other shapes generally known in the art. In some embodiments, piezoelectric ceramic tiles (e.g., 208) with different sizes and shapes are optionally installed at various locations on the inner surface (210) of the housing (202) (including, e.g., the inner surface of the second (cone frustum) portion (e.g., 216) of the housing) to create a wave field having an intensity gradient. In some embodiments, the plurality of piezoelectric ceramic tiles are optionally connected to the power supply and control unit using one or more electrical connection devices such as wires, flexible printed circuits, and embedded printed metal traces, as well as other electrical connection devices generally known in the art. In some embodiments, one or more holes are optionally embedded in the housing in order to pass electrical connection from outside the housing to the shock wave generators.

In some embodiments, the plurality of shock wave generators optionally includes a plurality of conductive wire segments (e.g., 209) sandwiched by (e.g., fitting snugly between) the housing and a conductive film (e.g., 211). In some embodiments, the plurality of conductive wire segments (e.g., 209) are electrically insulated from the conductive film (e.g. 211). The plurality of wire segments are optionally configured to transmit an electrical signal, and the conductive film (e.g., 211) are optionally configured to momentarily deform in response to an electromagnetic field generated by the electrical signal in the plurality of conductive wire segments. In some embodiments, the conductive wire or trace segments optionally include one continuous wire disposed on the inner surface of the housing. In some embodiments, the wire or trace segments optionally have one or more of the following layout shapes: serpentine (e.g., electrical current in two neighboring segments run in the opposite directions), or angular (e.g., neighboring trace segments are neither parallel nor perpendicular with each other).

In some embodiments, each conductive wire segment (e.g., 209) optionally includes a turn in the conductive wire or trace, the conductive wire or trace wound in the shape of a coil. In other words, electrical current in two neighboring wire or trace segments run in the same direction. In some embodiments each turn of the conductive coil is optionally separated from its nearest neighboring coil turn by the same distance (e.g., the conductive wire coil is wound with a constant winding density). In some embodiments, each turn in the conductive wire is optionally connected to its two neighboring wire segments. In some embodiments, the conductive wire segments are optionally formed by one continuous conductive wire or trace. In some embodiments, the distance between two neighboring coil turns may be different (e.g., the winding density of the conductive wire coil varies). Varying the winding density (e.g. the distance between neighboring conductive wire segments) optionally enables changing the intensity gradient of the generated shock wave without needing to vary the electrical signal from the power supply and control unit (e.g., 400). In some embodiments, each conductive wire or trace segment is optionally not connected with the neighboring wire or trace segments; in other words, each turn in the conductive wire or trace is optionally connected directly to the control and power supply unit through a corresponding electrical connection not shared with another turn of conductive wire or trace. Such a design allows the control and power supply unit to control individually the intensity of the shock wave generated by each turn of conductive wire or trace, thereby forming a shock wave field with an intensity gradient, which can selectively deliver shockwaves of varying intensities to different parts of the body member under treatment, thereby offering user more customization and control over the treatment.

In some embodiments, the plurality of shock wave generators (e.g., 208) are optionally configured to generate a shock wave field having an intensity gradient, the shock wave field include the corresponding shock waves (pressure pulses) generated by each shock wave generator. In other words, in some embodiments the shock wave pressure pulse generated by each of the plurality of shock wave generators form collectively a shock wave field. In some embodiments the shock wave field optionally has an intensity gradient (e.g., the intensity of the shock wave field is optionally divergent instead of uniform. In some embodiments, the intensity gradient is optionally achieved by varying the placement densities of the shock wave generators on the inner surface of the housing; for example, in exemplary embodiments where the housing (e.g., 202) optionally includes a second portion (e.g. 215) having a shape of a cone frustum, a higher density of a plurality of shock wave generators are optionally disposed on the second (e.g. cone frustum) portion (e.g., the distance separating piezoelectric tiles 208 disposed on the cone frustum portion are smaller than the distance separating piezoelectric tiles disposed on the cylindrical portion, or the distance separating conductive wires 209 disposed on the cone frustum portion are smaller than the distance separating conductive wires disposed on the cylindrical portion). In some embodiments, the intensity gradient is optionally achieved by varying the size of the shockwave generators (e.g., 208) on the inner surface of the housing (e.g., using larger piezoelectric tiles in the cone frustum portion than in the cylindrical portion). In some embodiments, the intensity gradient is optionally achieved by varying the amplitude of an electrical signal (e.g., a pulsed voltage signal in an exemplary embodiment where the plurality of shockwave generators are optionally piezoelectric tiles (e.g., 208), or a pulsed current signal in an exemplary embodiment where the plurality of shockwave generators are optionally conductive wire segments (e.g., 209) and a conductive thin film (e.g., 211). In some embodiments, the intensity gradient is achieved optionally by placing the shock wave generators to create constructive interference to increase intensity at various three-dimensional locations within the cavity, or to create destructive interference to decrease intensity at various three-dimensional locations within the cavity (e.g., 204). In some embodiments the intensity gradient is achieved optionally by using shockwave generators that have varying sizes and shapes. In some embodiments, the intensity gradient is optionally between a minimum intensity and a maximum intensity. In some embodiments, the intensity gradient is optionally between 0.01 $mJ/mm^2$ per pulse and 0.1 $mJ/mm^2$ per pulse. In some embodiments, the intensity gradient is optionally between 0.1 mJ/mm$^2$ per pulse and 0.2 mJ/mm$^2$ per pulse. In some embodiments, the intensity gradient is optionally between 0.2 mJ/mm$^2$ per pulse and 0.4 mJ/mm$^2$ per pulse. In some embodiments, the intensity gradient is optionally between 0.4 mJ/mm$^2$ per pulse and 4 mJ/mm$^2$ per pulse.

In some embodiments, each corresponding shock wave optionally has an adjustable intensity. In some embodiments, a subset of the shock wave generators (e.g., 208) optionally generates corresponding shock waves that have a different intensity than the corresponding shock waves generated by the rest of the plurality of shock wave generators. In some embodiments the subset of shock wave generators optionally includes one shock wave generator. In some embodiments, the different levels of intensity are optionally achieved using the controller/power supply unit (e.g., 402). The configurable intensity gradient of the shock waves generated offers more customizable treatment options for various indications and severities, thereby making the shock wave therapy more effective.

In some embodiments, a detached membrane is optionally configured to sheathe the penis. In some embodiments, the detached membrane is optionally made from elastic material such as latex, polyurethane, polyisoprene, or other material generally known in the art.

In some embodiments, the coupling assembly (e.g., 212) optionally includes a sac (e.g., 218) disposed on the first surface of the housing, the sac configured to contain a volume of liquid. In some embodiments, the sac is optionally made from elastomers such as natural rubber, neoprene rubber, or Thermoplastic Elastomers (TPE). In some embodiments, the shock wave transmitting liquid is optionally saline water, distilled water, or other suitable types of liquids generally known in the art. In some embodiments, the sac is optionally configured to cover substantially the entire length (e.g., axial length of the cylinder portion 214 and optionally the cone frustum portion 216) of the housing. In some embodiments, the sac is optionally configured to inflate inward until the sac touches the penis or optionally press against the penis at a predetermined pressure. In some embodiments, the predetermined pressure is optionally preset by the power supply and control unit (e.g., 402). In some embodiments the predetermined pressure is optionally adjustable at the power supply and control unit. The deformable coupling assembly with the optional sac allows generated shock waves be transmitted more effectively to the penis under treatment, thereby increasing the treatment efficacy and reducing treatment time.

In some embodiments, the sac (e.g., 218) is optionally configured to deform in accordance with the volume of liquid contained in the sac. In some embodiments, the sac is optionally configured to cover substantially the entire height of the housing. In some embodiments, the sac is optionally configured to inflate inward (e.g., reducing the cross-sectional diameter of the portion of the cavity in the housing not occupied by the inflated sac), thereby pressing the inward surface of the sac against the penis inserted into the cavity. In some embodiments, the minimum volume of liquid the sac is configured to hold is optionally 1%, 5%, 10%, 15%, 20%, 25%, 30%, 35%, 40%, or 45% of the volume of the cavity. In some embodiments, the maximum volume of liquid the sac is configured to hold is optionally 95%, 90%, 85%, 80%, 75%, 70%, 60%, and 65% of the volume of the cavity. In some embodiments, the minimum volume of liquid in the sac is optionally independent from the maximum volume of liquid in the sac; in other words, there is no one-to-one correspondence between the listed minimum volume and the maximum volume of liquid in the sac. In some embodiments, the sac includes optionally a first opening with an inlet/outlet control. In some embodiments, the inlet/outlet control is optionally connected to a tube that fills the sac with or drains from the sac the shock wave transmission liquid. The volume of the liquid b can be adjusted real-time during the operation, so that the sac can be naturally conformed to the penis being treated. Additional coupling gel/liquid can be further applied between the sac and the penis to improve transmission efficiency.

In some embodiments, the extracorporeal shock wave apparatus optionally includes a control and power supply unit (e.g., 400) configured to connect electrically to the plurality of shock wave generators, the control and power supply unit configured to control the coupling assembly and a group of the plurality of shock wave generators. In some embodiments, the group of the shock wave generators is optionally a subset (including one) of the shock wave generators. In some embodiments the group of the shock wave generators is all of the shock wave generators. In some embodiments, the control and power supply unit optionally generates an electrical control signal to be sent to the shock wave generators. In some embodiments the electrical control signal is optionally a pulse voltage signal to control one or more piezoelectric ceramic tile shock wave generator. In some embodiments, the electrical control signal is optionally a pulse current signal to control a conductive wire segment shock wave generator. In some embodiments, the control and power supply unit optionally includes one or more user-selectable settings that adjust the intensity of shock wave pressure pulses produced by a group of the shock wave generators by, for example, adjusting a magnitude or a phase of the pulse voltage signal or the pulse current signal. In some embodiments the control and power supply unit optionally controls the inflation and deflation of the deformable sac in the coupling assembly by filling the deformable sac with shock wave transmission fluid or draining shock wave transmission fluid from the deformable sac. In some embodiments, the control and power supply unit optionally includes one or more user-selectable settings that adjust the amount of shock wave transmission fluids in the sac. In some embodiments, the control and power supply unit optionally receives an electrical signal corresponding to a measured pressure value from the coupling unit and, in accordance with the measure pressure, stops filling the sac with shock wave transmission liquid. The control unit improves usability of the shock wave device by providing easy ways to adjust the intensity of generated shock waves and the coupling between the shock wave device and the penis being treated, thereby making the shock wave therapy more effective.

Figure 5A:
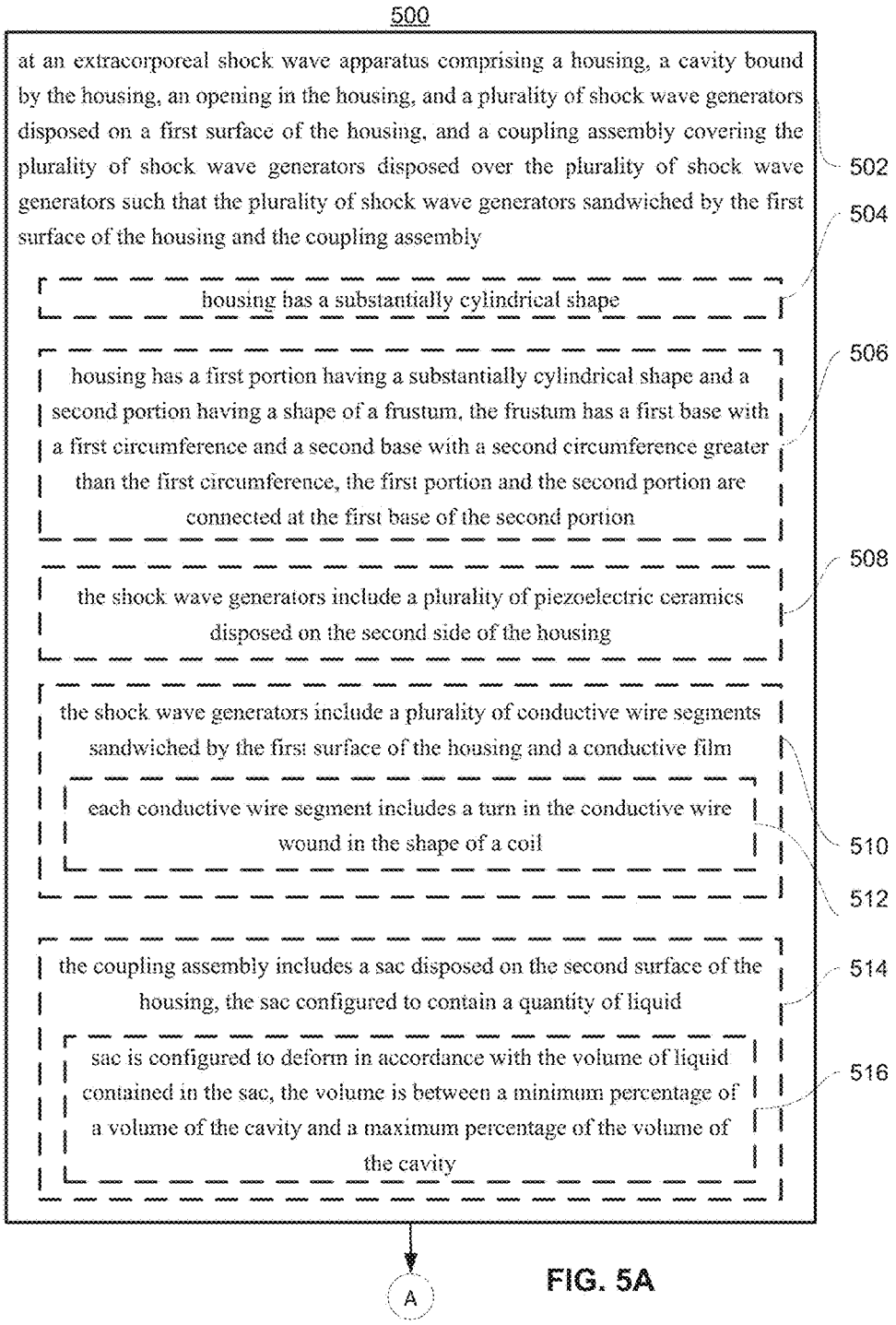
FIGS. 5A-5C illustrate methods of using a shock wave device according to various aspects of the present disclosure.
Figure 5B:
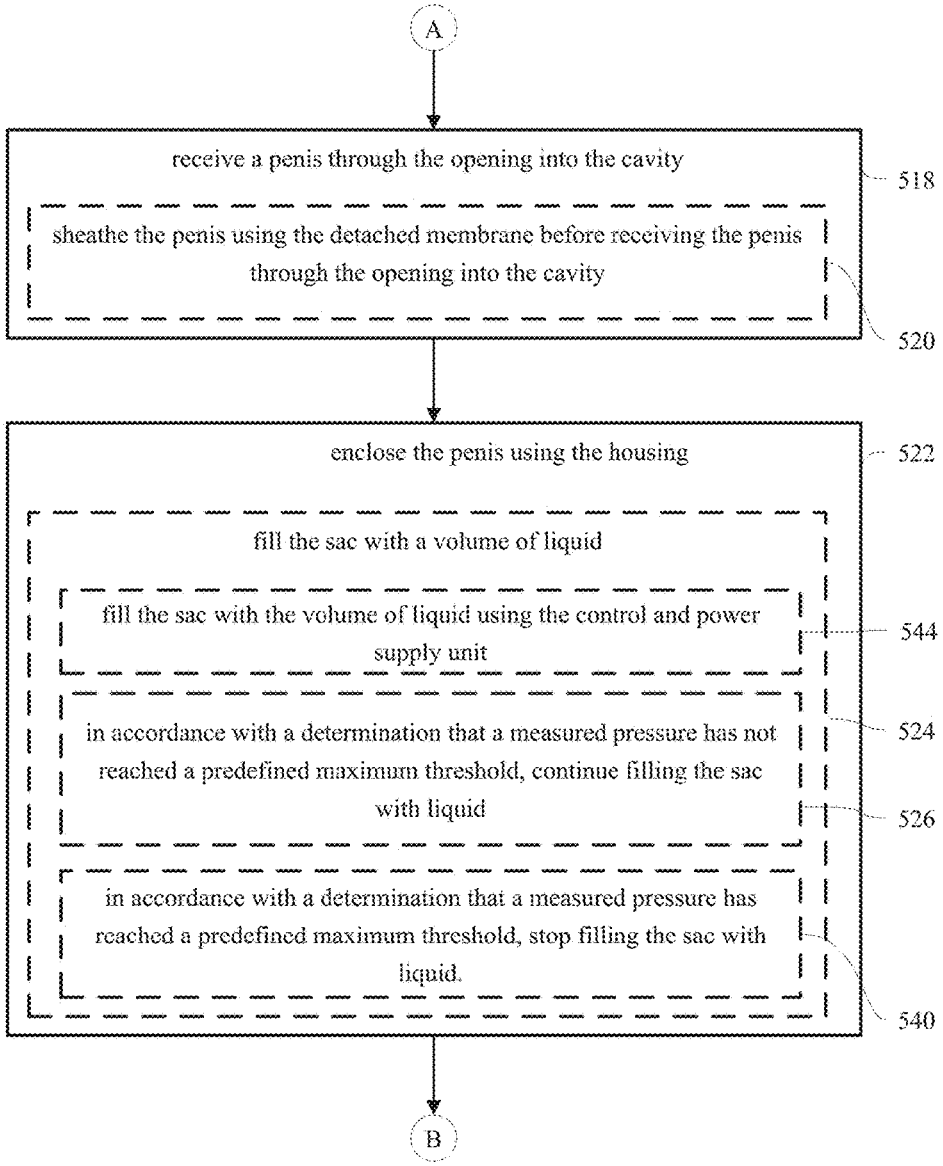
Figure 5C:
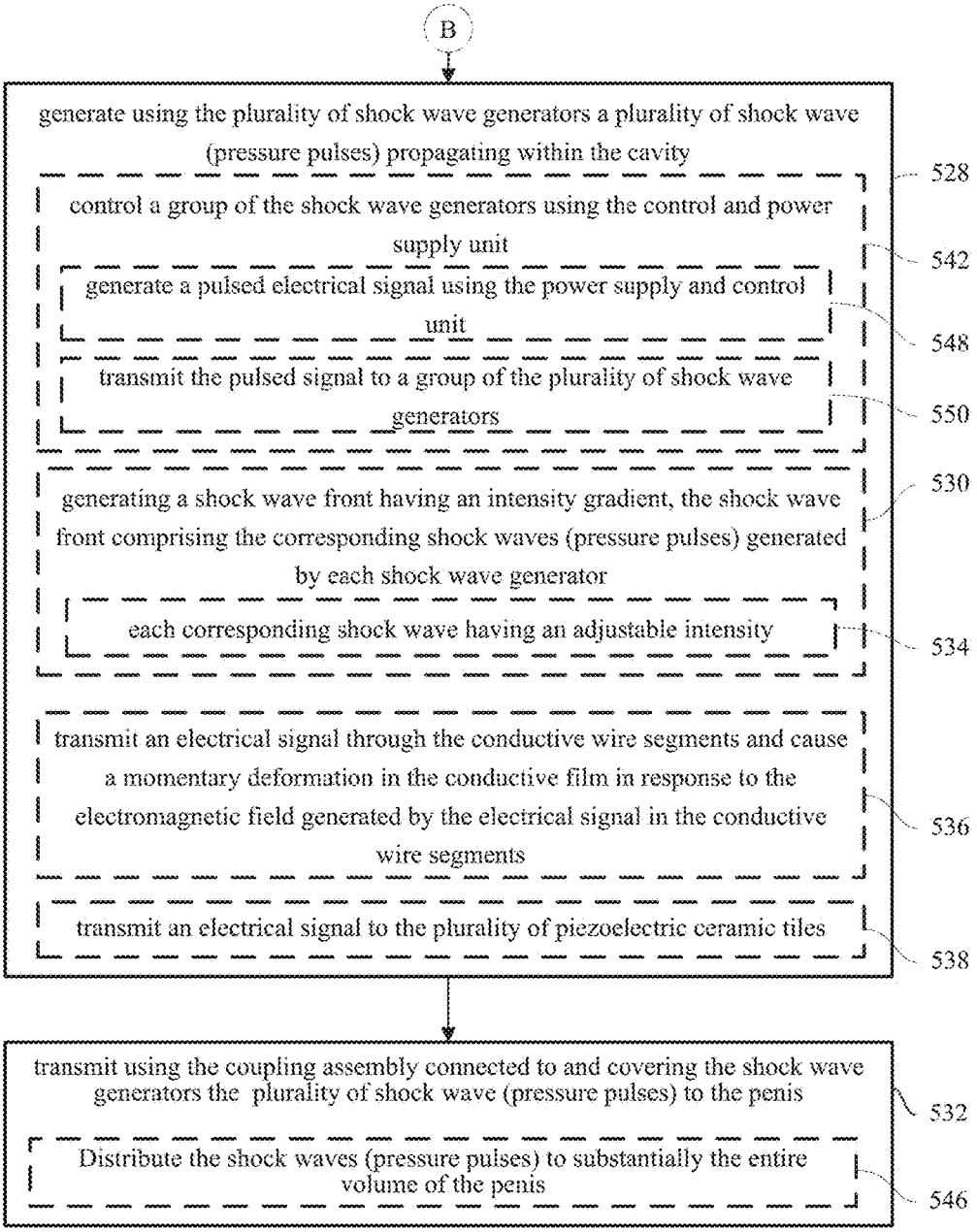

FIGS. 5A-5C illustrate methods of using a shock wave device according to various aspects of the present disclosure. In some embodiments, the method includes (e.g., step 502) using an extracorporeal shock wave apparatus (e.g., 200) that includes a housing (e.g., 202), a cavity (204), a first opening in the housing (e.g., 206), and a plurality of shock wave generators (e.g., 208) disposed on a first surface (e.g., 210) of the housing (e.g., 202), and a coupling assembly (e.g., 212) connected to and covers the plurality of shock wave generators disposed on the first surface of the housing to: receive a penis through the first opening into the cavity (e.g., step 518); enclose the penis using the housing (e.g., step 522); generate, using the plurality of shock wave generators (e.g., 208), a plurality of shock wave (pressure pulses) propagating within the cavity (e.g., step 528); and transmit, using the coupling assembly connected to and covering the plurality of shock wave generators, the plurality of shock wave (pressure pulses) to the body (e.g., step 532). In some embodiments, transmitting the plurality of shock wave (pressure pulses) to the penis optionally includes distributing the plurality of shock wave (pressure pulses) to substantially the entire volume of the penis (e.g., step 546).

In some embodiments, the housing disclosed in step 502 optionally has a substantially cylindrical shape (e.g., step 504). In some embodiments, the housing disclosed in step 500 optionally includes a first portion (e.g., 214) having a substantially cylindrical shape and a second portion (e.g., 216) having a shape of a cone frustum, the cone frustum has a first base with a first circumference and a second base with a second circumference greater than the first circumference, and the first portion and the second portion are optionally connected at the first base of the second portion (e.g., step 506).

In some embodiments, the shock wave generators disclosed in step optionally includes (e.g., step 508) a plurality of piezoelectric ceramic tiles (e.g., 208), and the method optionally includes transmitting an electrical signal to the plurality of piezoelectric ceramic tiles (e.g., step 538). In some embodiments, the shock wave generators optionally include (e.g., step 510) a plurality of conductive wire segments (e.g., a turn in the conductive wire wound in the shape of a coil (e.g., 209)) sandwiched by the first surface (e.g., 210) of the housing and a conductive film (e.g., 211), and the method optionally includes transmitting an electrical signal through the conductive wire segments and causing a momentary deformation in the conductive film in response to the electromagnetic field generated by the electrical signal in the conductive wire segments (e.g., step 536).

In some embodiments, the plurality of shock wave generators disclosed in step 502 optionally generates a shock wave field that has an intensity gradient, the shock wave field including the corresponding shock waves (pressure pulses) generated by each shock wave generator (e.g., step 530). In some embodiments each corresponding shock wave optionally has an adjustable intensity (e.g., step 534). In some embodiments, the intensity gradient is optionally between a minimum intensity and a maximum intensity. In some embodiments, the intensity gradient is optionally between 0.01 $mJ/mm^2$ per pulse and 0.1 $mJ/mm^2$ per pulse. In some embodiments, the intensity gradient is optionally between 0.1 $mJ/mm^2$ per pulse and 0.2 $mJ/mm^2$ per pulse. In some embodiments, the intensity gradient is optionally between 0.2 $mJ/mm^2$ per pulse and 0.4 $mJ/mm^2$ per pulse. In some embodiments, the intensity gradient is optionally between 0.4 $mJ/mm^2$ per pulse and 4 $mJ/mm^2$ per pulse.

In some embodiments, the coupling assembly optionally includes (e.g., step 514) a sac (e.g., 218) configured to contain a volume of liquid, and the method optionally includes filling the sac with a volume of liquid (e.g., step 524). In some embodiments, the sac is optionally configured to deform in accordance with the quantity of liquid contained in the sac, and the method optionally includes in accordance with a determination that a measured pressure (e.g., pressure of the liquid in the sac (e.g., 218)) has not reached a predefined maximum threshold, continuing filling the sac with liquid (e.g., step 526). In some embodiments, the method optionally includes in accordance with a determination that the measured pressure (e.g., pressure of the liquid in the sac) has reached a predefined maximum threshold, stopping filling the sac with liquid (e.g., step 540).

In some embodiments, the shock wave apparatus (e.g., 200) optionally includes a control and power supply unit (e.g., 402) configured to connect electrically to the plurality of shock wave generators and the method optionally includes controlling a group of the plurality of shock wave generators (e.g.,) using the power supply and control unit (e.g., step 542). In some embodiments, the method optionally includes filling the sac with the volume of liquid using the control and power supply unit. In some embodiments, controlling a group of the plurality of shock wave generators using the power supply and control unit optionally includes the steps of generating, at the power supply and control unit (e.g., 400), a pulsed electrical signal (step 548) and transmitting the pulsed signal to a group of the plurality of shock wave generators (step 550). In some embodiments the electrical control signal is optionally a pulse voltage signal to control one or more piezoelectric ceramic tile shock wave generator. In some embodiments, the electrical control signal is optionally a pulse current signal to control a conductive wire segment shock wave generator. In some embodiments, the pulsed electrical signal optionally has a first amplitude, a first pulse width, and a first pulse repetition period (PRP). In some embodiments, the control and power supply unit (e.g., 402) optionally generates a second pulsed electrical signal that has a second amplitude, a second pulse width, and a second pulse repetition period, where the second amplitude is optionally different from the first amplitude, the second pulse width is optionally different from the first pulse width, and the second pulse repetition period is optionally different from the first pulse repetition period.

It will be appreciated that the apparatuses and processes of the present invention can have a variety of embodiments, only a few of which are disclosed herein. It will be apparent to the artisan that other embodiments exist and do not depart from the spirit of the invention. Thus, the described embodiments are illustrative and should not be construed as restrictive.

What is claimed is:

1. A device comprising:

an extracorporeal shock wave apparatus, wherein the apparatus comprises:

a housing configured to enclose a penis in a cavity bound by the housing, the housing including:

a first opening configured to receive the penis into the cavity; and a substantially cylindrical inner surface extending longitudinally from the first opening, wherein a first inner surface portion of the substantially cylindrical inner surface is parallel to a second inner surface portion of the substantially cylindrical inner surface that opposes the first inner surface portion;

a plurality of shock wave generators disposed on the substantially cylindrical inner surface of the housing, wherein:

each shock wave generator of the plurality of generators is configured to generate a respective shock wave propagating within the cavity; and a first shock wave generator of the plurality of shock wave generators is disposed on the first inner surface portion and generates a plurality of shock waves perpendicularly away from the first inner surface portion and perpendicularly toward the second inner surface portion; and a coupling assembly covering the plurality of shock wave generators disposed over the plurality of shock wave generators such that the plurality of shock wave generators being sandwiched by the housing and the coupling assembly, wherein:

the coupling assembly is configured to transmit the plurality of shock waves to the penis; and the coupling assembly includes a deformable sac configured to conform to a shape of the penis.

2. The device in claim 1, wherein the housing has a substantially cylindrical shape.

3. The device in claim 1, wherein the housing comprises a first portion having a substantially cylindrical shape and a second portion having a shape of a cone frustum, the cone frustum having a first base with a first circumference and a second base with a second circumference greater than the first circumference, the first portion and the second portion being connected at the first base of the second portion.

4. The device in claim 1, wherein the plurality of shock wave generators are configured to generate a shock wave field having an intensity gradient, the shock wave field comprising the corresponding shock waves (pressure pulses) generated by each shock wave generator.

5. The device in claim 4, wherein each corresponding shock wave has an adjustable intensity.

6. The device in claim 1, wherein the plurality of shock wave generators comprise a plurality of piezoelectric ceramics tiles.

7. The device in claim 1, wherein the plurality of shock wave generators comprises a plurality of conductive wire segments sandwiched by the housing and a conductive film, the plurality of conductive wire segments configured to conduct an electrical signal, and the conductive film configured to momentarily deform in response to an electromagnetic field generated by the electrical signal in the plurality of conductive wire segments.

8. The device in claim 7, wherein each conductive wire segment comprises a turn in a conductive wire wound in the shape of a coil.

9. The device in claim 1, wherein the deformable sac is configured to contain a volume of liquid.

10. The device in claim 9, wherein the deformable sac is configured to deform in accordance with the volume of liquid contained in the deformable sac, wherein the volume of liquid is between a minimum percentage of a volume of the cavity and a maximum percentage of the volume of the cavity.

11. The device in claim 1, further comprising a control and power supply unit, including one or more pulse generating circuitry, configured to connect to the plurality of shock wave generators, the control and power supply unit configured to control the coupling assembly and a group of the plurality of shock wave generators.

12. The device in claim 1, further comprising a detached membrane configured to sheathe the penis.

13. The device of claim 1, wherein the plurality of shock wave generators are disposed along the circumference of the substantially cylindrical inner surface of the housing and longitudinally along the substantially cylindrical inner surface of the housing.

14. A method comprising:

at an extracorporeal shock wave apparatus comprising:

a housing, a cavity bound by the housing, a first opening in the housing, a substantially cylindrical inner surface extending longitudinally from the first opening, wherein a first inner surface portion of the substantially cylindrical inner surface is parallel to a second inner surface portion of the substantially cylindrical inner surface that opposes the first inner surface portion, a plurality of shock wave generators disposed on the substantially cylindrical inner surface of the housing, including a first shock wave generator of the plurality of shock wave generators disposed on the first inner surface portion, and a coupling assembly disposed over the plurality of shock wave generators such that the plurality of shock wave generators being sandwiched by the housing and the coupling assembly, wherein the coupling assembly includes a deformable sac configured to conform to the shape of a penis:

receiving the penis through the first opening into the cavity;

enclosing the penis using the housing;

generating, using the plurality of shock wave generators, a plurality of shock wave (pressure pulses) propagating within the cavity, wherein the first shock wave generator of the plurality of shock wave generators generates shock waves perpendicularly away from the first inner surface portion and perpendicularly toward the second inner surface portion; and transmitting, using the coupling assembly connected to and covering the plurality of shock wave generators, the plurality of shock wave (pressure pulses) to the penis.

15. The method in claim 14, wherein the housing has a substantially cylindrical shape.

16. The method in claim 14, wherein the housing comprises a first portion having a substantially cylindrical shape and a second portion having a shape of a cone frustum, the cone frustum having a first base with a first circumference and a second base with a second circumference greater than the first circumference, the first portion and the second portion being connected at the first base of the second portion, the method further comprising:

transmitting, using the coupling assembly, shock waves to a portion of the penis inside a torso.

17. The method in claim 14, wherein generating a plurality of shock wave (pressure pulses) propagating within the cavity comprising generating a shock wave field having an intensity gradient, the shock wave field comprising the corresponding shock waves (pressure pulses) generated by each shock wave generator.

18. The method in claim 17, wherein each corresponding shock wave has an adjustable intensity.

19. The method in claim 18, wherein the plurality of shock wave generators comprises a plurality of piezoelectric ceramic tiles, the method further comprising:

transmitting an electrical signal to the plurality of piezoelectric ceramic tiles.

20. The method in claim 19, wherein the plurality of shock wave generators comprises a plurality of conductive wire segments sandwiched by the first surface of the housing and a conductive film, the method further comprising:

transmitting an electrical signal through the plurality of conductive wire segments; and causing the conductive film to momentarily deform in response to an electromagnetic field generated by the electrical signal in the plurality of conductive wire segments.

21. The method in claim 20, wherein each conductive wire segment comprises a turn in a conductive wire wound in the shape of a coil.

22. The method in claim 14, wherein the deformable sac is disposed on a second surface of the housing, wherein the deformable sac is configured to contain a volume of liquid, the method further comprising: filling the deformable sac with the volume of liquid.

23. The method in claim 22, wherein the deformable sac is configured to deform in accordance with the volume of liquid contained in the deformable sac, the method further comprising:

in accordance with a determination that a measured pressure of the deformable sac has not reached a predefined maximum threshold, continuing filling the deformable sac with the liquid; and in accordance with a determination that the measured pressure of the deformable sac has reached the predefined maximum threshold, stopping filling the deformable sac with the liquid.

24. The method in claim 23, wherein the apparatus further comprises a control and power supply unit, including one or more pulse generating circuitry, configured to connect electrically to the plurality of shock wave generators, the method further comprising:

controlling a group of the plurality of shock wave generators using the power supply and control unit; and filling the deformable sac with the volume of liquid using the control and power supply unit.

25. The method in claim 24, wherein controlling the group of the plurality of shock wave generators using the power supply and control unit comprises:

generating, at the power supply and control unit, a pulsed electrical signal; and transmitting the pulsed signal to the group of the plurality of shock wave generators.

26. The method of claim 14, wherein transmitting the plurality of shock wave to the penis includes distributing the plurality of shock wave to substantially the entire volume of the penis.

27. The method of claim 14, wherein the apparatus further comprises a detached membrane configured to sheathe the penis, the method further comprising sheathing the penis with the detached membrane before receiving the penis through the first opening into the cavity.

28. The method of claim 14, wherein the plurality of shock wave generators are disposed along the circumference of the substantially cylindrical inner surface of the housing and longitudinally along the substantially cylindrical inner surface of the housing.

* * * * *